US005199680A

United States Patent [19]

Rivera

[11] Patent Number: 5,199,680

[45] Date of Patent: Apr. 6, 1993

[54] BOOK HOLDER APPARATUS

[76] Inventor: Luis A. Rivera, 17 Avenida 16-96, Zona 11, Anillo Periferico, Guatemala

[21] Appl. No.: 783,527

[22] Filed: Oct. 28, 1991

[51] Int. Cl.[5] ..... A47B 5/00

[52] U.S. Cl. ..... 248/441.1; 248/454; 248/458

[58] Field of Search ..... 248/441.1, 444.1, 450, 248/451, 454, 458, 460, 413

[56] References Cited

U.S. PATENT DOCUMENTS

| | | | |
|---|---|---|---|
| 1,009,508 | 11/1911 | Guthrie | 248/454 |
| 1,494,212 | 5/1924 | Bromley | 248/454 |
| 1,559,366 | 10/1925 | Phelps, Jr. | 248/451 X |
| 2,104,072 | 1/1938 | Carr | 248/458 |
| 2,244,773 | 6/1941 | Hawk | 248/451 |
| 2,807,908 | 10/1957 | Lykes | 248/451 |
| 3,889,914 | 6/1975 | Torme | 248/451 X |
| 4,511,157 | 4/1985 | Wilt, Jr. | 248/125 X |
| 4,978,096 | 12/1990 | Struckman | 248/451 |
| 5,054,736 | 10/1991 | Champoux | 248/451 X |
| 5,058,848 | 10/1991 | Ferraro | 248/444.1 |

FOREIGN PATENT DOCUMENTS

| | | | |
|---|---|---|---|
| 608077 | 9/1948 | United Kingdom | 248/451 |

*Primary Examiner*—Carl D. Friedman
*Assistant Examiner*—Derek J. Berger
*Attorney, Agent, or Firm*—Leon Gilden

[57] ABSTRACT

A book holder apparatus includes a housing member mounted rotatably about a second support post that in turn is orthogonally mounted relative to a first support post, wherein the first support post is orthogonally secured relative to a base and in a modified aspect of the invention, is rotatably mounted relative to the base. A plurality of first support posts arranged in a parallel relationship on opposed sides of the housing are arranged for securement and positioning of books of greater weight as required.

2 Claims, 4 Drawing Sheets

BOOK HOLDER APPARATUS

BACKGROUND OF THE INVENTION

1. Field of the Inventon

The field of invention relates to book holder apparatus, and more particularly pertains to a new and improved book holder apparatus wherein the same is arranged for rotative mounting relative to a support post structure.

2. Description of the Prior Art

Book holder apparatus of various types are utilized in the prior art to permit securement and positioning of an associated book member to free an individual's arms relative to the holding and positioning in a relatively open or closed position of the associated book. Book holder apparatus of the prior art has typically been of a cumbersome or expansive nature to preclude universal utilization by individuals. Examples of the prior art include U.S. Pat. No. 3,884,538 to Wise setting forth an example of such a book holder member utilizing a housing structure relative to a plate member to mount a book in an opened manner relative to an illumination structure.

U.S. Pat. No. 3,823,312 to Weinstein provides for a clamping structure ot secure a book at its spine below an associated illumination member.

U.S. Pat. No. 4,591,124 to Hellebrand, et al. sets forth an articulated linkage to mount a book structure relative to a remote distal end of the linkage structure.

U.S. Pat. No. 4,553,728 to Corsello sets forth a book stand arranged for positioning a book between opposed flange structures.

As such, it may be appreciated that there continues to be a need for a new and improved book holder apparatus as set forth by the instant invention which addresses both the problems of ease of use as well as effectiveness in construction and in this respect, the present invention substantially fulfills this need.

SUMMARY OF THE INVENTION

In the view of the foregoing disadvantages inherent in the known types of book holder apparatus now present in the prior art, the present invention provides a book holder apparatus wherein the same is arranged for mounting a book in a rotative and pivotal relationship relative to an individual utilizing the structure for reading of the associated book. As such, the general purpose of the present invention, which will be described subsequently in greater detail, is to provide a new and improved book holder apparatus which has all the advantages of the prior art book holder apparatus and none of the disadvantages.

To attain this, the present invention provides a book holder apparatus including a housing member mounted rotatably about a second support post that in turn is orthogonally mounted relative to a first support post, wherein the first support post is orthogonally secured relative to a base and in a modified aspect of the invention, is rotatably mounted relative to the base. A plurality of first support posts arranged in a parallel relationship on opposed sides of the housing are arranged for securement and positioning of books of greater weight as required.

My invention resides not in any one of these features per se, but rather in the particular combinataion of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the forgoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved book holder apparatus which has all the advantages of the prior art book holder apparatus and none of the disadvantages.

It is another object of the present invention to provide a new and improved book holder apparatus which may be easily and efficiently manufactured and marketed.

It is a further object of the present invention to provide a new and improved book holder apparatus which is of a durable and reliable constuction.

An even further object of the present invention is to provide a new and improved book holder apparatus which is susceptible of a low cost of manufacture with regard to both materials and labor, and which accordingly is then susceptible of low prices of sale to the consuming public, thereby making such book holder apparatus economically available to the buying public.

Still yet another object of the present invention is to provide a new and improved book holder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes referece to the annexed drawings wherein.

DESCRIPTIOIN OF THE PREFERRED EMBODIMENT

Figure 1:
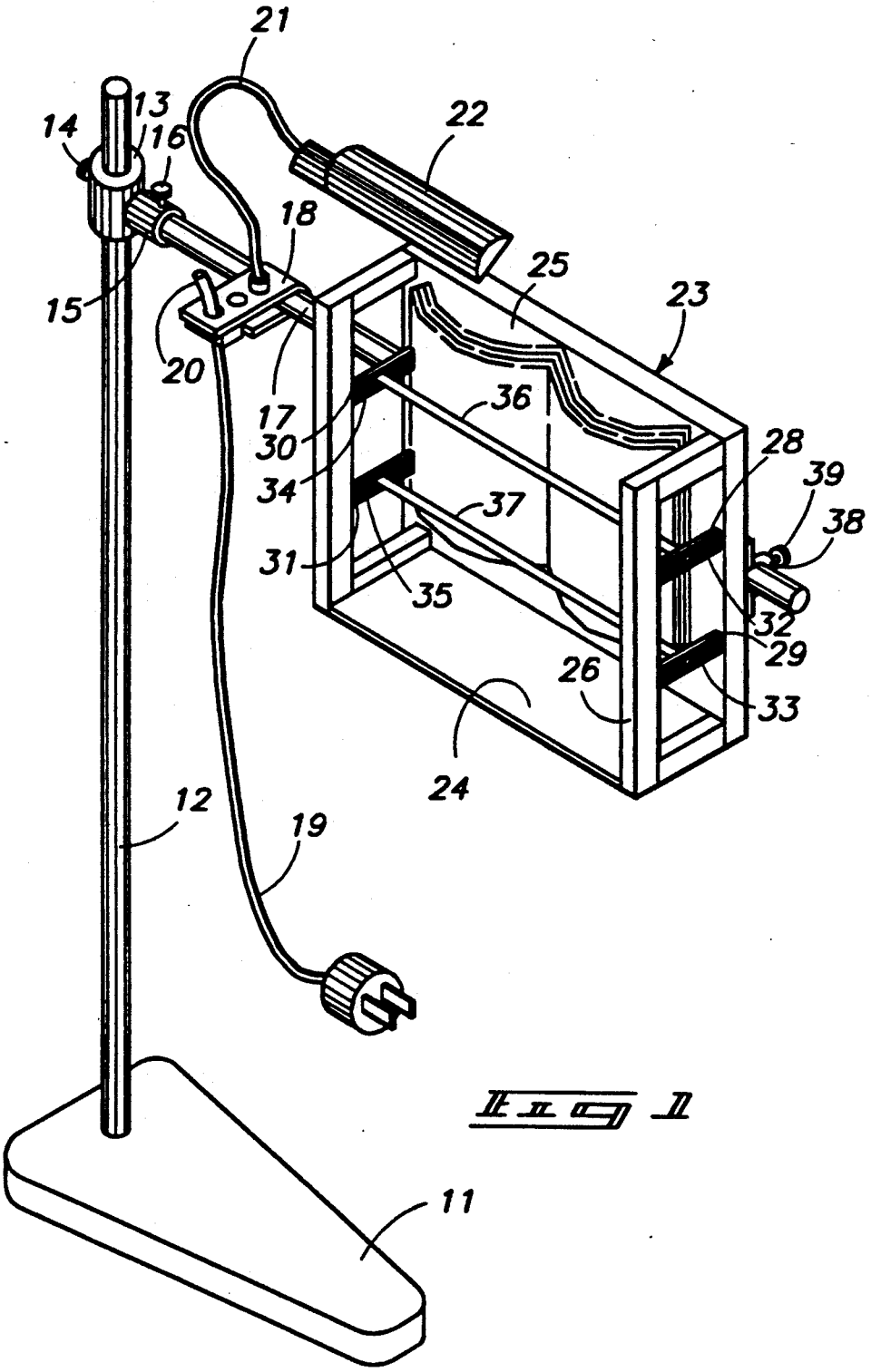
FIG. 1 is an isometric illustration of the instant invention.
Figure 4:
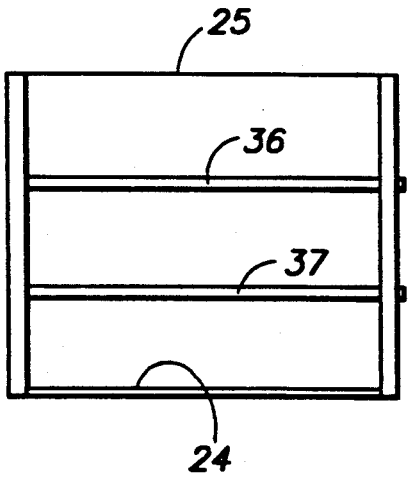
FIG. 4 is an orthographic view, taken along the lines 4—4 of FIG. 3 in the direction indicated by the arrows.
Figure 3:
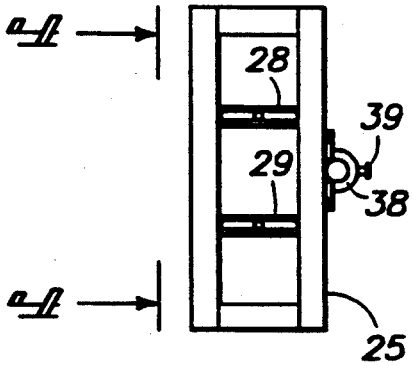
FIG. 3 is an orthographic side view of the instant invention.
Figure 2:
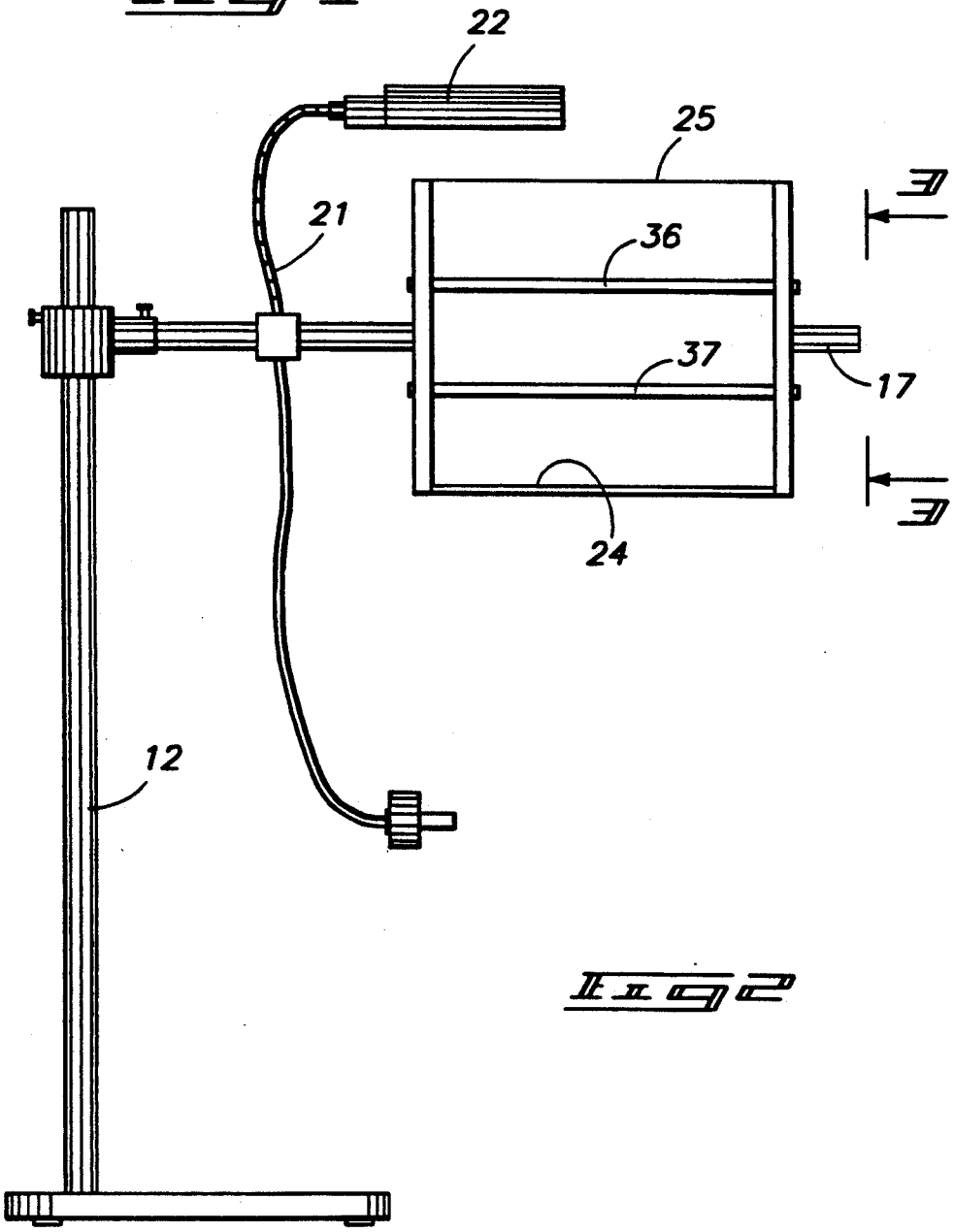
FIG. 2 is an orthographic frontal view taken of the invention.

With reference now to the drawings, and in particular to FIGS. 1 to 6 thereof, a new and improved book holder apparatus embodying the principles and concepts of the present invention and generally designated by the reference numeral 10 will be described.

More specifically, the book holder apparatus 10 of the instant invention essentially comprises a rigid pedestal base 11 orthogonally mounting a first support post 12 thereto, wherein the first support post extends upwardly relative to the pedestal base and includes a first support post collar 13 slidably and complementarily receiving the first support post 12 therethrough, with a locking fastener 14 radially directed through the first support post collar 13 to fixedly secure the collar 13 in a desired vertical orientation relative to the first support post 12. A collar sleeve 15 orthogonally oriented relative to the first support post collar 13 and integrally mounted thereto is defined by a collar sleeve axis orhtogonally oriented relative to the support post collar axis of the support post collar 13. A collar sleeve lock fastener 16 radially directed through the collar sleeve 15 selectively secures a second support post orthogonally relative to the first support post 12. A support bracket 18 fixedly mounted to the second support post 17 includes a switch 20 mounted thereto, with an electrical power supply cord 19 directed to the switch 20 to direct electrical energy selectively through the switch 20 to an illumination bulb mounted within the illumination housing 22 secured to the bracket 18 by a flexible goose neck member 21, as illustrated.

A housing member 23 including a housing floor 24 with a housing rear wall 25 fixedly and orthogonally mounted to the floor 24 extending upwardly thereof is provided, with the rear wall 25 to include a plurality of rear wall loop members 38 coaxially aligned relative to one another mounted to a rear surface of the rear wall 38, with each loop member including a lock fastner 39 (see FIGS. 1 and 3 for example) to rotatably secure the second support post 17 directed through the loop members 38 in a fixed rotative relationship relative to the loop members and the rear wall 25. A right side wall frame leg 26 and a left side wall frame leg 27 extend upwardly and orthogonally relative to the floor 24 relative to opposed right and left sides of the floor 24 and spaced forwardly and parallel relative to the rear wall 25. A right upper and right lower slotted plate 28 and 29 are coplanar relative to one another and are orthogonally oriented relative to the right side wall frame leg 26 and the rear wall 25. A left upper and lower respective slotted plate 30 and 31 are coplanar relative to one another, parallel to the right upper and lower slotted plates 28 and 29 and orthogonally oriented between the left side wall frame leg 27 and the rear wall 25. A first slot 32 directed through the right upper slotted plate 28 is coplanar with a third slot 34 directed through the left upper slotted plate defining a first plane, with a second plane defined by a second slot 33 and a fourth slot 35 directed through the right and left lower slotted plates 29 and 31. The first rod 36 is directed through the first and third slots 32 and 34, with a second rod 37 directed through the second and fourth slots 33 and 35. The rods are frictionally and securedly maintained within the respective slots to secure a book member, as illustrated in FIG. 1 in phantom, between the rods and a forward surface of the rear wall 25.

Figure 5:
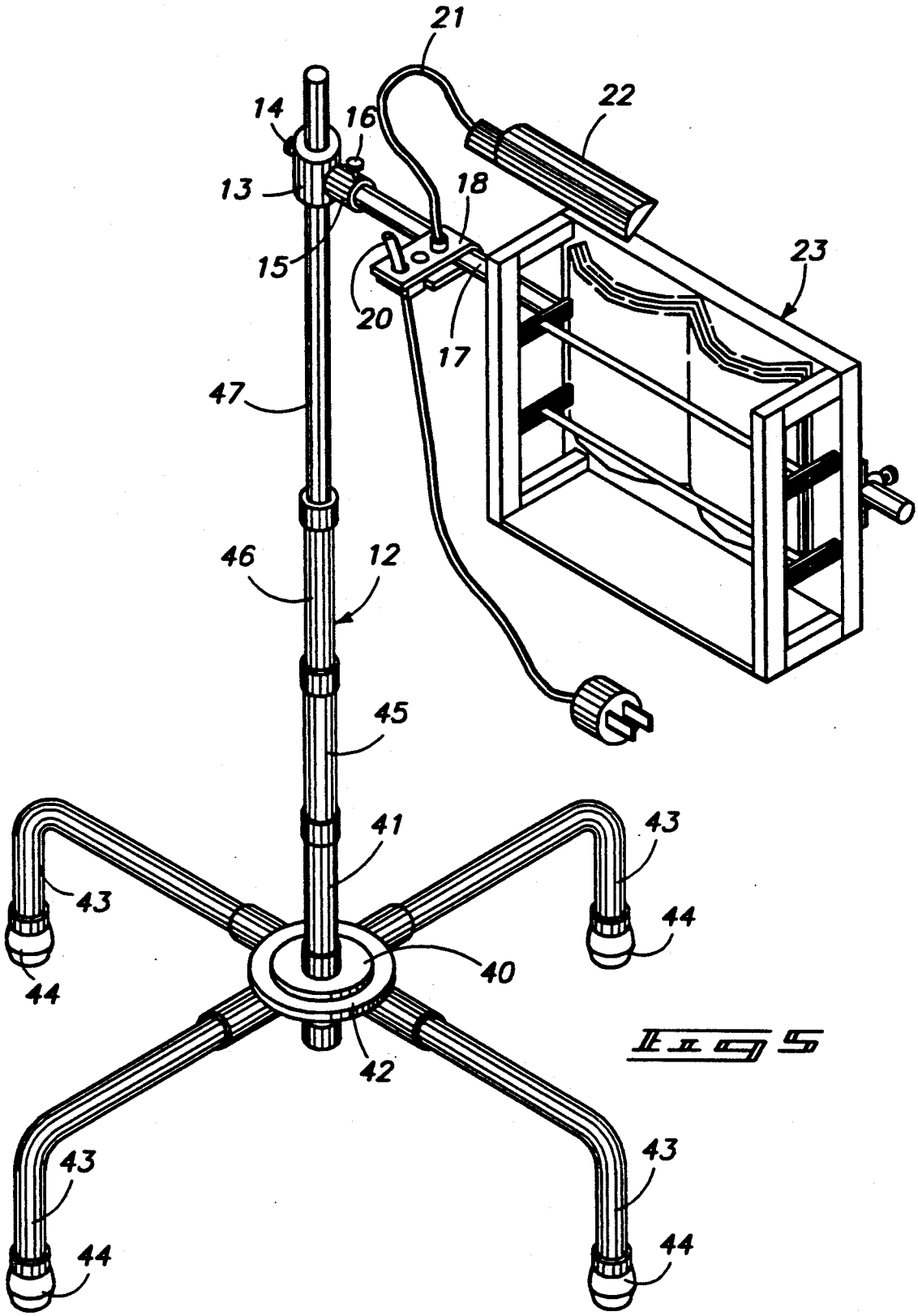
FIG. 5 is an isometric illustration of a modified mounting post structure of the invention.
Figure 6:
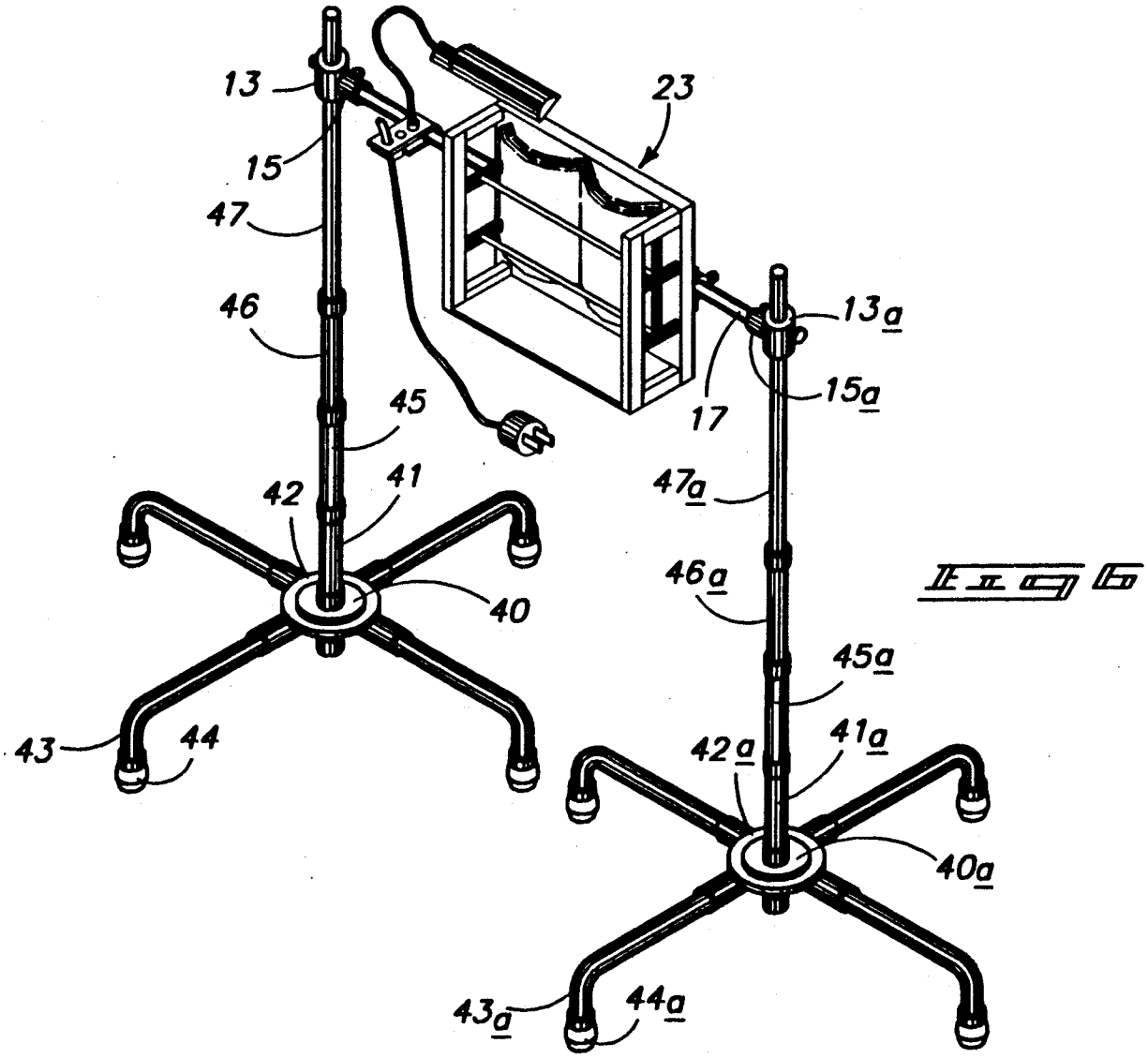
FIG. 6 is an isometric illustration of a modified aspect of the invention utilizing a plurality of support posts relative to the book holder housing member.

FIG. 5 illustrates a modified first support post structure 12 to include a first base plate 40 rotatably mounted relative to a second base plate 42 that in turn secures plural pairs of support legs 43, each support leg 43 mounting a caster 44 at a lower terminal end thereof, wherein the support legs are arranged parallel relative to one another and orthogonally relative to the second base plate 42. A first sleeve 41 is fixedly and orthogonally mounted to an upper terminal end of the first base plate 40, with a second sleeve 45 telescopingly received within the first sleeve, a third sleeve 46 telescopingly received within the second sleeve, and a modified first support post 47 telescopingly received within the third sleeve 46. Locking collars are provided to telescopingly secure the respective sleeves and rods relative to one another. In the aspect of the invention as set forth in FIG. 6, the second support post 17 is mounted to the first support post collar 13 at a left distal end of the second support post 17, wherein a right distal end of the second support post 17 is secured within a second collar sleeve 15*a* orthogonally mounted to a further second support post 47*a* that includes a second support post collar 13*a* orthogonally mounting the second collar sleeve 15*a*. The second support post 47*a* is telescopingly received within a third sleeve 46*a* that in turn is telescopingly received within a further second sleeve 45*a* and in turn telescopingly received within a further first sleeve 41*a*. A third base plate 40*a* is integrally mounted to a lower terminal end of the further first sleeve 41*a* and is rotatably secured to a fourth base plate 42*a*, in turn mounting further pairs of support legs 43*a* each including a further caster 44*a* at a lower terminal end of each of the further support legs 43*a*. The further support legs are each in arranged in pairs and parallel relative to one another in a manner as the support legs 43. The utilization of the first and second support posts 47 and 47*a* respectively enhance ease of mounting of the housing 23 limiting deflection by support of cumbersome book members mounted therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A book holder apparatus, comprising, a pedestal, the pedestal including a first support post orthogonally mounted relative to the pedestal, the first support post including a first support post collar complementarily and slidably receiving the first support post therewithin, wherein a first fastener radially directed through the first support post collar fixedly secures the first support post collar relative to the first support post, and a collar sleeve integrally mounted in orthogonal orientation relative to the first support post collar, and a second support post received within the collar sleeve, and a second fastener radially directed into the collar sleeve fixedly secures the second support post relative to the collar sleeve and orthogonally orients the second support post relative to the first support post, and a housing member rotatably mounted relative to the second support post, and a support bracket fixedly secured to the second support post includes a flexible goose neck member mounted to the support bracket, and an illumination housing mounted to an upper distal end of the goose neck, with an illumination member mounted within the illumination housing, and a switch member mounted to the support bracket to effect selective actuation of the illumination member, and the illumination housing positioned above the housing member, wherein the housing member is arranged for securement of a book member therewithin, and the housing member includes a housing floor, and the housing floor including a housing rear wall orthogonally and fixedly mounted to the floor extending upwardly relative thereto, the rear wall including a rear wall rear surface and a rear wall forward surface, the rear wall rear surface including a plurality of coaxially aligned loop members fixedly mounted to the rear surface, each loop member including a loop fastener directed through the loop member, and the loop members receiving the second support post therethrough, and the loop fasteners intersecting the second support post in selective engagement to effect selective rotation of the second support post relative to the loop members, and a right upper slotted plate and a right lower slotted plate orthogonally and integrally mounted adjacent a right side edge of the rear wall, wherein the right upper slotted plate and the right lower slotted plate are arranged in a coplanar relationship relative to one another, and a left upper slotted plate and a left lower slotted plate are orthogonally mounted adjacent a left edge of the rear wall arranged in a coplanar relationship relative to one another, wherein the right upper slotted plate includes a first slot, the left upper slotted plate includes a third slot, the first slot and a third slot define a first plane, and the right lower slotted plate includes a second slot, and the left lower slotted plate includes a fourth slot, wherein the second slot and the fourth slot are coplanar to define a second plane, wherein the first plane is parallel relative to the second plane and spaced above the second plane, and the first slot and the third slot include a first rod frictionally engaged therethrough, and the second slot and the fourth slot include a second rod frictionally directed therethrough to secure a book member between the first rod and the forward surface of the rear wall and the second rod and the forward surface of the rear wall.

2. An apparatus as set forth in claim 1 wherein the pedestal includes a first base plate, said apparatus further comprising a first sleeve orthogonally and integrally mounted to said first base plate, a second sleeve telescopingly received within said first sleeve, a third sleeve telescopingly received within said second sleeve, said first support post being telescopingly received within said third sleeve, a second base plate rotatably mounted to said first base plate, said second base plate including a plurality of pairs of support legs, each of the support legs being arranged in a parallel relationship relative to one another.

* * * * *